US008517374B2

(12) United States Patent
Washino et al.

(10) Patent No.: US 8,517,374 B2
(45) Date of Patent: Aug. 27, 2013

(54) IMAGE FORMING DEVICE PROVIDED WITH SHEET CASSETTE HAVING IMPROVED INSERTING AND REMOVING WORKABILITY

(71) Applicants: Yoshiyuki Washino, Gifu-ken (JP); Yuji Koga, Nagoya (JP); Wataru Sugiyama, Nishio (JP)

(72) Inventors: Yoshiyuki Washino, Gifu-ken (JP); Yuji Koga, Nagoya (JP); Wataru Sugiyama, Nishio (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/627,566

(22) Filed: Sep. 26, 2012

(65) Prior Publication Data

US 2013/0140762 A1 Jun. 6, 2013

(30) Foreign Application Priority Data

Dec. 2, 2011 (JP) ..... 2011-265001

(51) Int. Cl.
*B65H 1/22* (2006.01)
*B65H 1/26* (2006.01)

(52) U.S. Cl.
CPC ..... *B65H 1/266* (2013.01)
USPC ..... 271/164; 271/145; 399/393; 312/348.4

(58) Field of Classification Search
USPC ..... 271/145, 164; 399/393; 312/348.4
See application file for complete search history.

(56) References Cited

U.S. PATENT DOCUMENTS 5,040,856 A * 8/1991 Wilkins et al. ..... 312/402
6,443,545 B1 * 9/2002 Woerner ..... 312/348.1
7,472,904 B2 * 1/2009 Park ..... 271/162

FOREIGN PATENT DOCUMENTS

JP 2011-051665 A 3/2011

* cited by examiner

*Primary Examiner* — Gerald McClain
(74) *Attorney, Agent, or Firm* — Baker Botts L.L.P.

(57) ABSTRACT

An image forming device includes: an image forming unit; a casing; a tray; a cover; and a handle portion. The image forming unit is configured to form an image on a sheet. The casing is formed with an opening and configured to accommodate the image forming unit therein. The tray is configured to accommodate in a stacked state a plurality of sheets to be fed toward the image forming unit. The tray is configured to be inserted into the casing through the opening to be attached to the casing and removed from the casing through the opening to be detached from the casing. The cover is configured to be connected to the tray and moved relative to the tray. The cover is configured to cover at least a part of the opening when the tray is attached to the casing. The handle portion is provided at the tray.

10 Claims, 10 Drawing Sheets

A CASE WHERE SHEET CASSETTE IS ATTACHED TO CASING

A CASE WHERE SHEET CASSETTE IS DETACHED FROM CASING

A CASE WHERE SHEET CASSETTE IS ATTACHED TO CASING

A CASE WHERE SHEET CASSETTE IS DETACHED FROM CASING

IMAGE FORMING DEVICE PROVIDED WITH SHEET CASSETTE HAVING IMPROVED INSERTING AND REMOVING WORKABILITY

CROSS REFERENCE TO RELATED APPLICATION

This application claims priority from Japanese Patent Application No. 2011-265001 filed Dec. 2, 2011. The entire content of the priority application is incorporated herein by reference.

TECHNICAL FIELD

The present invention relates to an image forming device for forming an image on a sheet.

BACKGROUND

For example, in a known image forming device, a sheet cassette can be detached from and attached to a casing through an opening formed in the casing. In a state where the sheet cassette is attached to the casing, the opening is closed by a cover assembled to the sheet cassette.

SUMMARY

In the known image forming device described above, the cover is connected to the sheet cassette through a coil spring so as to be movable with respect to the sheet cassette. Further, the cover has a handle portion that a user handles for inserting the sheet cassette into the casing and removing the sheet cassette from the casing.

Thus, the entire inserting and removing force generated when the sheet cassette is removed from and inserted into the casing is received by the coil spring, so that the coil spring is significantly deformed when the sheet cassette is removed from and inserted into the casing, which may reduce inserting and removing workability.

In view of the foregoing, it is an object of the present invention to provide an image forming device capable of suppressing a reduction in the inserting and removing workability of the sheet cassette.

In order to attain the above and other objects, the present invention provides an image forming device including: an image forming unit; a casing; a tray; a cover; and a holding portion. The image forming unit is configured to form an image on a sheet. The casing is formed with an opening and configured to accommodate the image forming unit therein. The tray is configured to accommodate in a stacked state a plurality of sheets to be fed toward the image forming unit. The tray is configured to be inserted into the casing through the opening to be attached to the casing and removed from the casing through the opening to be detached from the casing. The cover is configured to be connected to the tray and moved relative to the tray. The cover is configured to cover at least a part of the opening when the tray is attached to the casing. The handle portion is provided at the tray.

DETAILED DESCRIPTION

An inkjet printer as an image forming device according to one embodiment of the present invention will be described with reference to FIGS. 1 through 10D. Throughout the specification, the terms "upward", "downward", "upper", "lower", "above", "below", "beneath", "right", "left", "front", "rear" and the like will be used assuming that the image forming device is disposed in an orientation in which it is intended to be used. More specifically, in FIG. 1 a lower left side and an upper right side are a left side and a right side, respectively, and an upper left side and a lower right side are a rear side and a front side, respectively.

1. Outline of Image Forming Device Inkjet Printer

Figure 1:
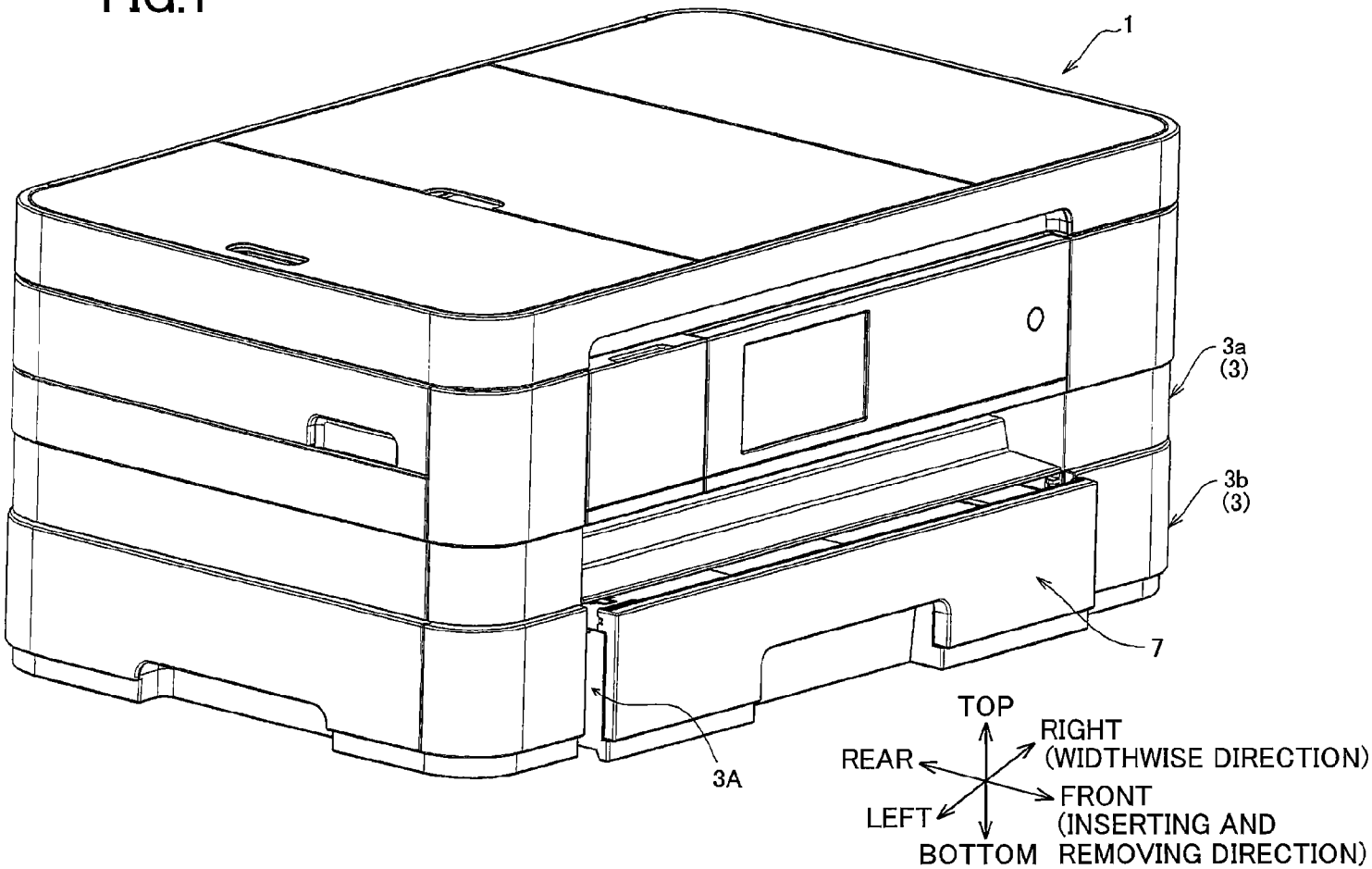
FIG. 1 is a perspective view of an outer appearance of an image forming device according to one embodiment of the present invention.
Figure 2:
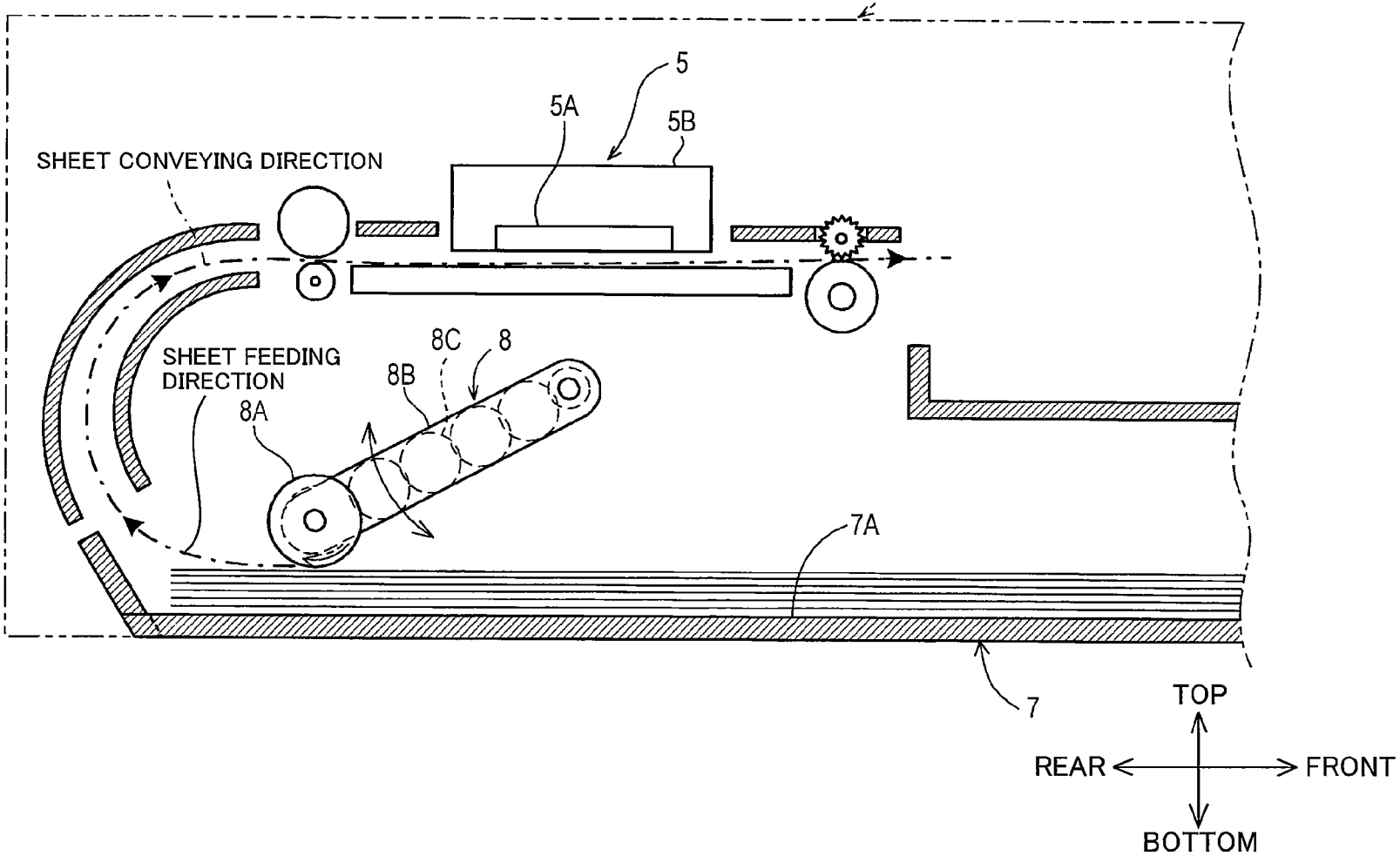
FIG. 2 is a conceptual view of the image forming device.

The image forming device 1 according to the embodiment has a generally hexahedron shape as illustrated in FIG. 1. The image forming device 1 includes a casing 3 constituting an exterior design thereof, and, as illustrated in FIG. 2, within the casing 3, an image forming unit 5 is provided. The image forming unit 5 is adapted to form an image on a rectangular shaped sheet such as a paper sheet.

The image forming unit 5 is an ink jet type image forming unit adapted to form an image on a sheet by ejecting fine ink droplets onto the sheet. More specifically, the image forming unit 5 includes a recording head 5A and a carriage 5B. The recording head 5A is adapted to eject ink droplets. The carriage 5B is adapted to reciprocatingly move the recording head 5A in a scanning direction in conjunction with intermittent sheet conveying timing.

Incidentally, the scanning direction refers to a direction in parallel to the sheet opposed to the recording head 5A, which is perpendicular to a conveying direction of the sheet.

A stacked portion 7A on which the sheet to be fed to the image forming unit 5 is placed is disposed below the image forming unit 5. Two or more sheets can be placed on the stacked portion 7A in a vertically stacked manner. Hereinafter, the vertical direction is also referred to as a staking direction.

The image forming device 1 further includes a sheet cassette 7. The stacked portion 7A is provided in the sheet cassette 7. The sheet cassette 7 is, as illustrated in FIG. 1, detachably attached to the casing 3, i.e., a main body of the image forming device 1, through an opening 3A formed in the casing 3. In the present embodiment, the sheet cassette 7 can be inserted into and removed out of the image forming device, i.e., the main body, in a frontward/rearward direction from a front side of the image forming device 1. More specifically, the sheet cassette 7 that has been detached from the image forming device 1 is inserted into the casing 3 toward a rear side thereof, so that the sheet cassette 7 can be attached to the casing 3. Further, the sheet cassette 7 that has been attached to the image forming device 1 is removed from the casing 3 toward a front side thereof, so that the sheet cassette 7 can be detached from the casing 3. Thus, hereinafter, the frontward/rearward direction will also be referred to as an inserting and removing direction.

In a state where the sheet cassette 7 is attached to the main body, the entire stacked portion 7A is accommodated in the main body. Thus, when the stacked portion 7A is replenished with the sheets, a user needs to draw the sheet cassette 7 from the main body to expose the stacked portion 7A to an outside.

It is noted that when the sheet cassette 7 is pulled out from the main body for replenishing the sheets, the sheet cassette 7 protrudes outside the casing 3 through the opening 3A, but may be partly mounted in the casing 3. That is, as long as the stacked portion 7A can be replenished with the sheets, the sheet cassette 7 may not be detached from the casing 3, but be still partly attached to the casing 3. In other words, when the expressions such that the sheet cassette 7 is detached from the casing 3 and the sheet cassette 7 is removed from the casing 3 are used in the specification and claims, the expression implies not only a state where the sheet cassette 7 is completely detached from the casing 3 but also a state where the sheet cassette 7 is still partly attached to the casing 3.

Here, the main body implies a portion of the image forming device 1, such as a casing or a frame, that is not disassembled or removed by the user at a normal operation. The casing 3 according to the present embodiment includes a first casing 3*a* in which the image forming unit 5 is accommodated and a second casing 3*b* in which the sheet cassette 7 is accommodated.

The opening 3A through which the sheet cassette 7 is removed from and inserted into the casing 3 is formed in the second casing 3*b*. Hereinafter, unless otherwise specified, the casing 3 implies the second casing 3*b* in which the opening 3A is formed.

Further, the image forming device 1 includes a feeding device 8, as illustrated in FIG. 2. The feeding device 8 is adapted to feed the sheets stacked on the stacked portion 7A to the image forming unit 5. The feeding device 8 includes a sheet supply roller 8A, a holding member 8B, and a transmission mechanism 8C.

The sheet supply roller 8A rotates in contact with an upper surface of an uppermost sheet stacked on the stacked portion 7A in the stacking direction to impart a conveying force to the sheet. The holding member 8B is an arm-like member extending downward from above the sheet cassette 7. The holding member 8B has an upper end portion assembled to the main body so as to be pivotally movable about the upper end portion, and a lower end portion to which the sheet supply roller 8A is rotatably assembled.

The transmission mechanism 8C is provided with a power transmission device, such as a gear and a belt, for transmitting a rotation force to the sheet supply roller 8A. The sheet supply roller 8A is provided at a position on a downstream side in a sheet feeding direction relative to a center of pivotal movement of the holding member 8B. A drive source (not shown) such as an electric motor supplies a rotation force to the power transmission device.

Incidentally, the sheet feeding direction refers to a direction parallel to a moving direction of the sheet to be fed by the conveying force received from the sheet supply roller 8A. In the present embodiment, the sheet feeding direction coincides with the frontward/rearward direction of the image forming device 1.

2. Detailed Structure of Sheet Cassette

Figure 3:
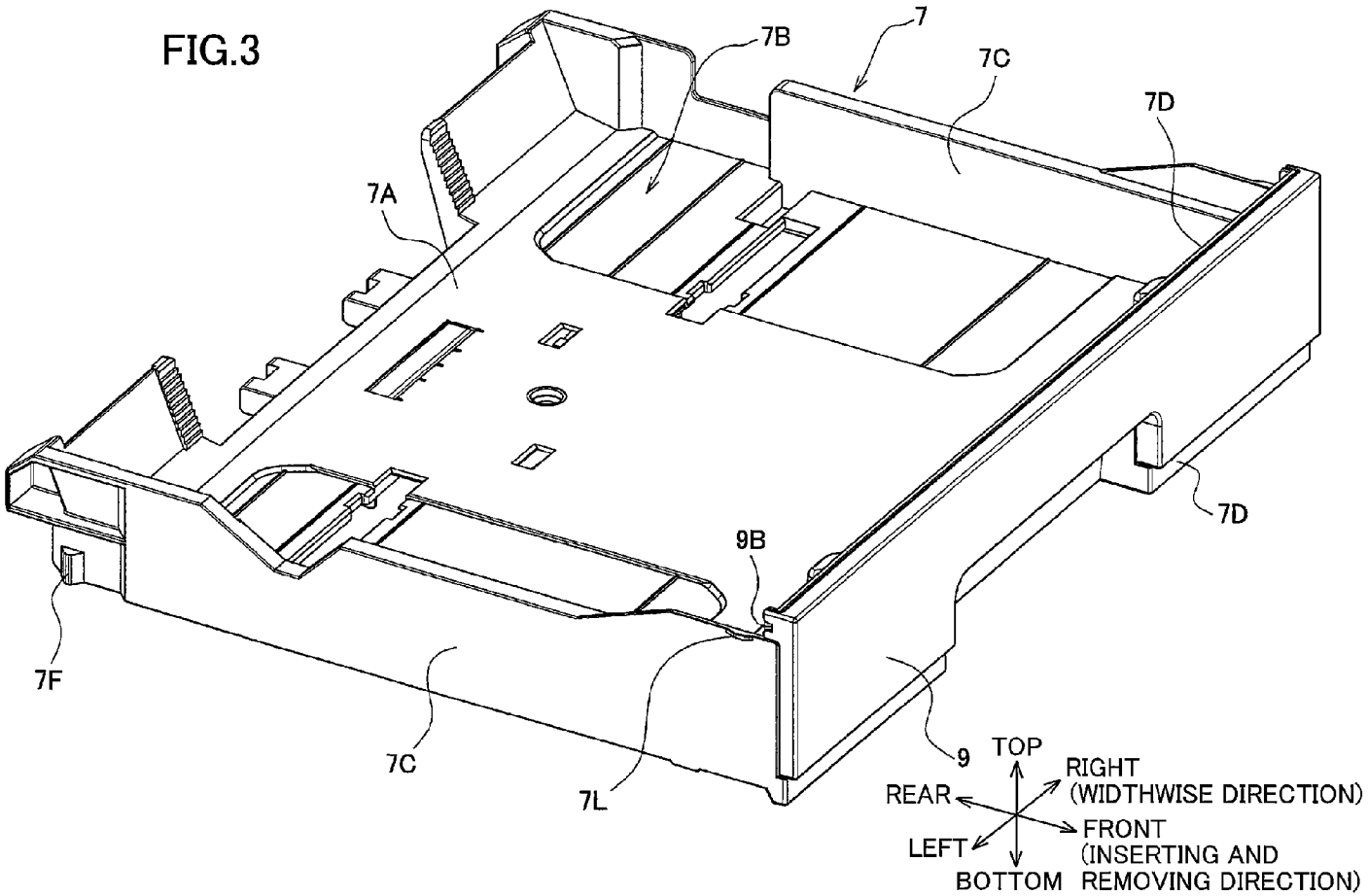
FIG. 3 is a perspective view of a sheet cassette provided in the image forming device.

As illustrated in FIG. 3, the sheet cassette 7 is generally dish-like shaped and formed of resin. The sheet cassette 7 is integrally provided with a stacked plate 7B constituting the stacked portion 7A, and walls 7C, 7C, and 7D. The stacked plate 7B is generally rectangular shaped. The walls 7C, 7C, and 7D surround at least three sides of the stacked plate 7B. A pair of walls 7C, 7C is provided at both ends of the stacked portion 7A in a widthwise direction thereof so as to be opposed to each other. Incidentally, the widthwise direction refers to a direction perpendicular to the sheet feeding direction (the inserting and removing direction) and the stacking direction.

The pair of walls 7C, 7C has outer surfaces on which positioning projections 7F are provided at rear end portions thereof in the frontward/rearward direction. Each of the positioning projections 7F is contactable with the main body when the sheet cassette 7 is attached to the main body (casing 3).

Correspondingly, the main body is provided with urging members (not shown) contactable with the positioning projections 7F when the sheet cassette 7 is attached to the main body. Each of the urging members exerts a pressing force (resilient force) on the corresponding positioning projection 7F to press the sheet cassette 7 in the inserting direction (in a direction from front to rear).

Further, the sheet cassette 7 is provided with an abutment portion (not shown) contactable with the main body. The positioning projections 7F are pressed by the urging members in a state where the abutment portion is in contact with the main body and, thereby, the sheet cassette 7 is subjected to positioning with respect to the main body in the inserting and removing direction.

Further, the sheet cassette 7 is provided with positioning projections 7L. Each of the positioning projections 7L contacts the casing 3 when the sheet cassette 7 is attached to the main body, so that the sheet cassette 7 is subjected to positioning with respect to the main body in the widthwise direction.

The wall 7D is provided at an end portion of the stacked portion 7A on an upstream side in the sheet feeding direction, i.e., at a front end portion of the stacked portion 7A in the frontward/rearward direction. The wall 7D has a front surface covered by a panel cover 9 provided so as to be opposed to the wall 7D.

Figure 4:
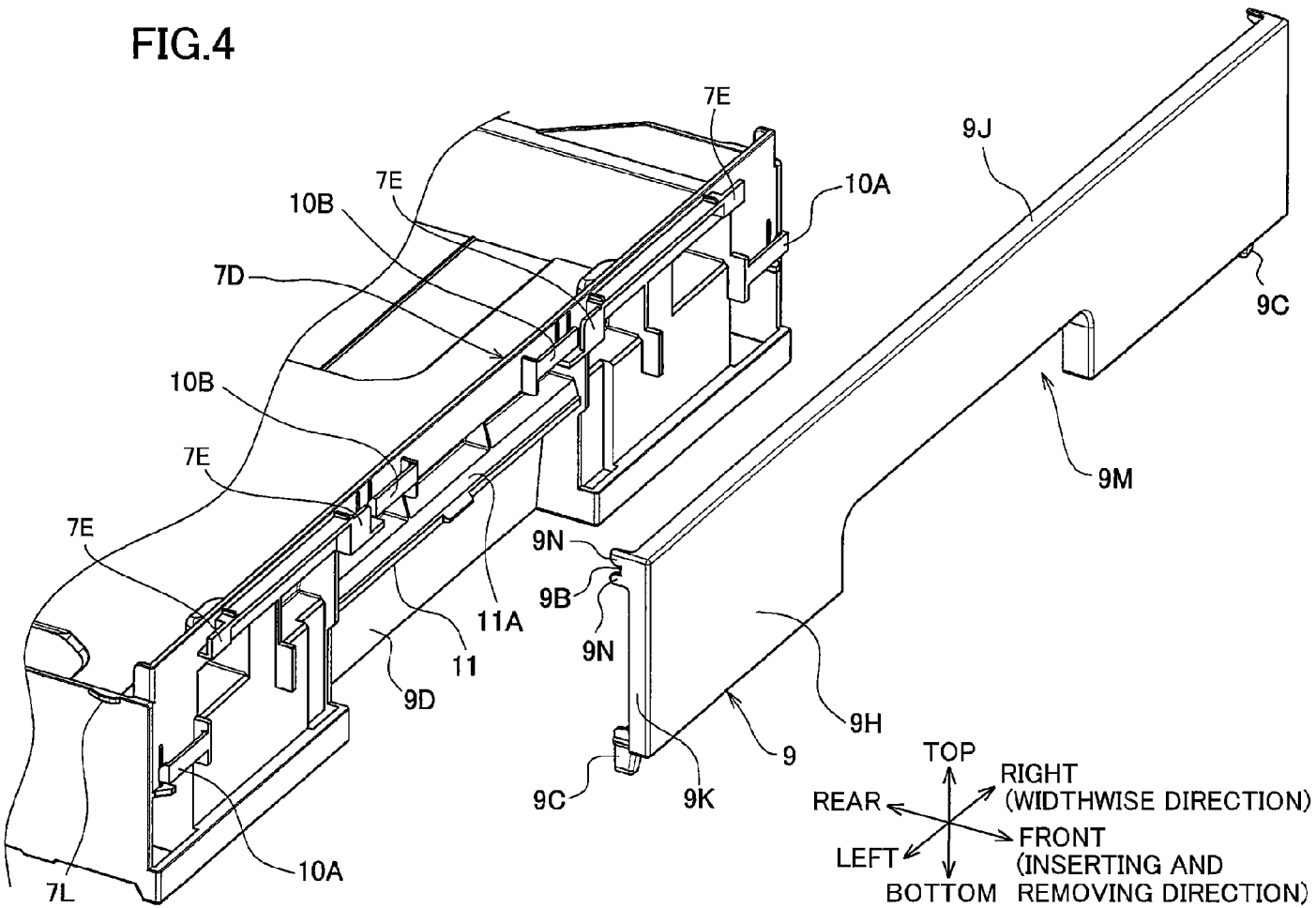
FIG. 4 is an exploded perspective view of a front portion of the sheet cassette.

As illustrated in FIG. 4, the panel cover 9 is connected to the wall 7D, i.e., the sheet cassette 7, through a plurality of resiliently deformable resilient members 10A, 10B. The resilient members 10A, 10B are leaf-spring like members extending in the widthwise direction. The resilient members 10A, 10B are formed of resin and integral with the front surface of the wall 7D. In this embodiment, two resilient members 10A and two resilient members 10B are provided in the sheet cassette 7.

Figure 5:
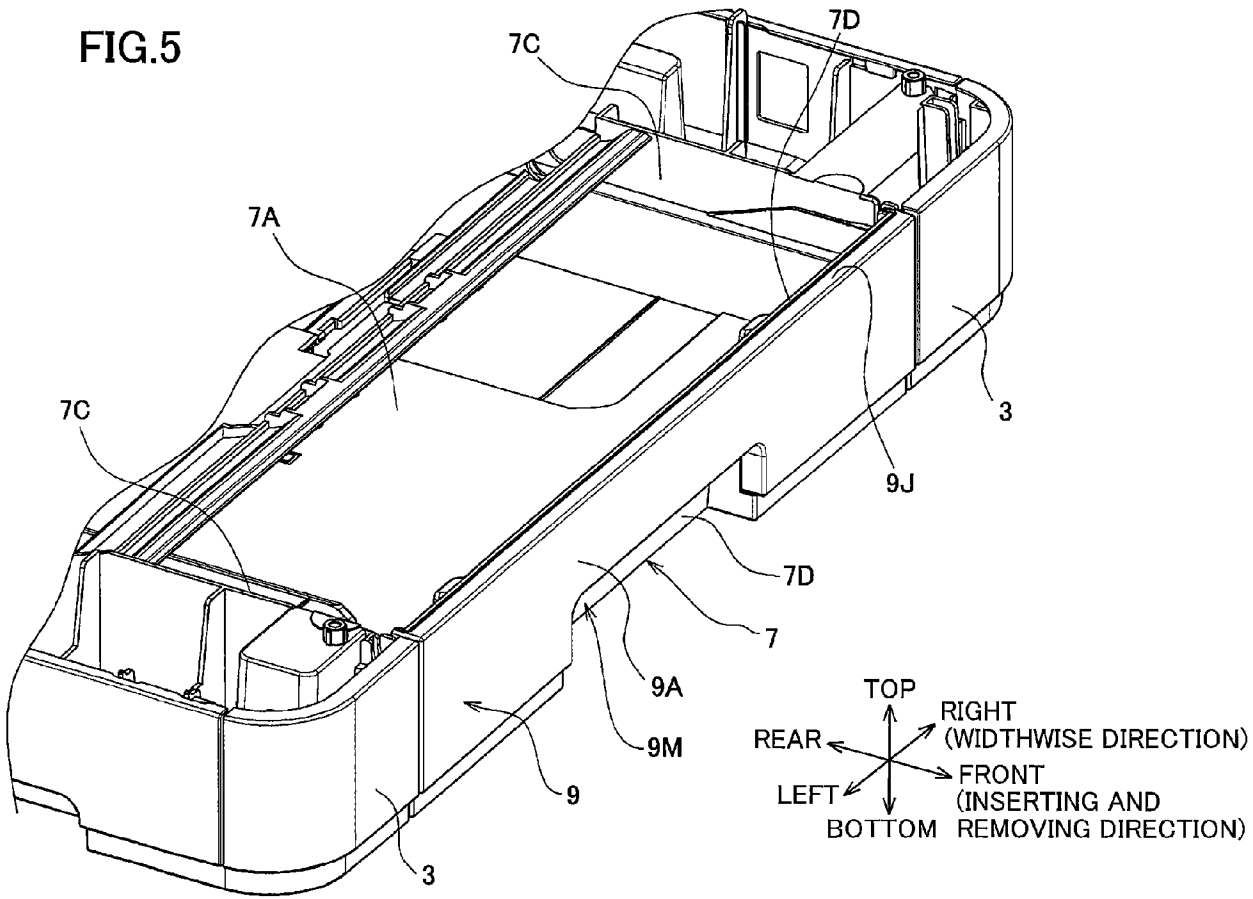
FIG. 5 is a perspective view illustrating a state where the sheet cassette is attached to a casing of the image forming device.

With this configuration, the panel cover 9 can be moved in the inserting and removing direction with respect to the wall 7D, i.e., the sheet cassette 7. Thus, when the sheet cassette 7 is inserted through the opening 3A to be attached to the casing 3, the entire sheet cassette 7 is positioned farther inside the casing 3 than an outer surface 9A of the panel cover 9 is, and the substantially entire area of the opening 3A is closed by the panel cover 9, as illustrated in FIG. 5.

Figure 8:
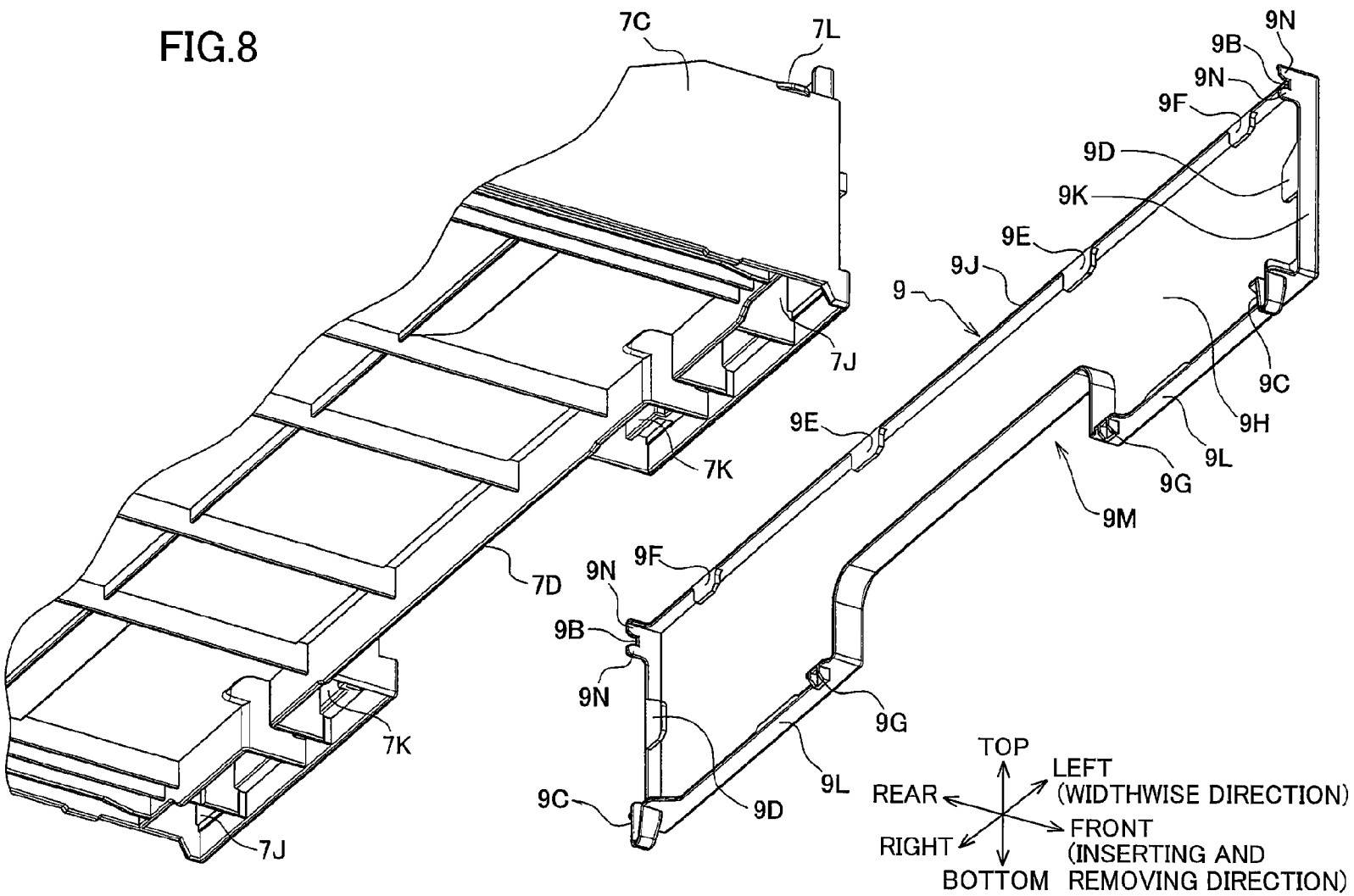
FIG. 8 is an exploded perspective view of the front portion of the sheet cassette.

As illustrated in FIG. 8, the panel cover 9 is provided with a main portion 9H, an upper wall 9J, a pair of side walls 9K, and a lower wall 9L. The main portion 9H is strip plate like shaped. The upper wall 9J protrudes rearward from an upper edge of the main portion 9H. The pair of side walls 9K protrudes rearward from each widthwise edge of the main portion 9H. The lower wall 9L protrudes rearward from a lower edge of the main portion 9H. These walls 9J, 9K, and 9L and the base portion 9H are integral with each other and formed of resin.

Further, as illustrated in FIG. 4, the sheet cassette 7 is provided with a handle portion 11 for the user to handle the sheet cassette 7. The handle portion 11 is provided at the wall 7D, i.e., a portion of the sheet cassette 7 on the panel cover 9 side. The handle portion 11 is provided at a center portion of the wall 7D in the widthwise direction.

The handle portion 11 according to the present embodiment is a gutter-like portion defined by the wall 7D and a protruding wall 11A protruding downward from the wall 7D at the widthwise center portion thereof. The handle portion 11 extends in the widthwise direction so as to be depressed upward and to be opened downward. Thus, the handle portion 11 is positioned between the sheet cassette 7 and the panel cover 9 in the inserting and removing direction of the sheet cassette 7.

Figure 6:
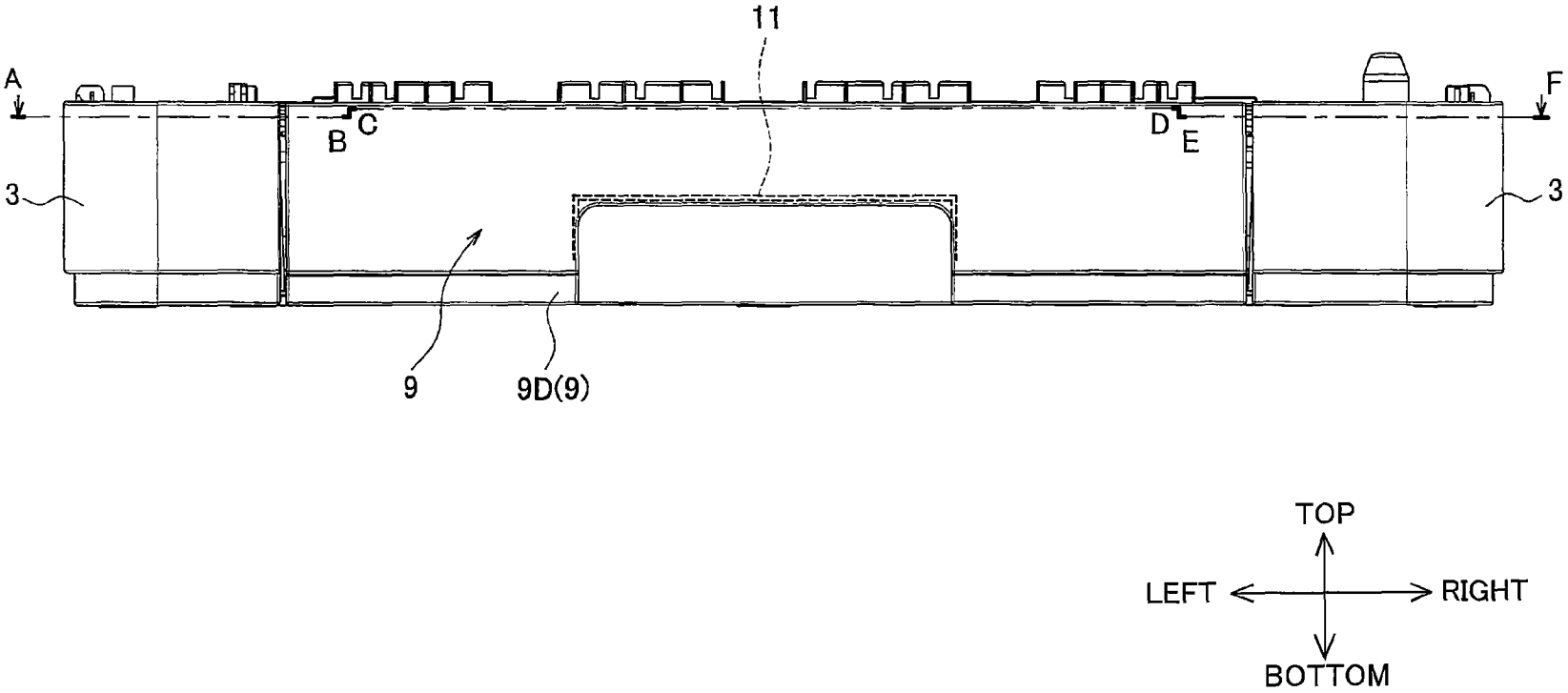
FIG. 6 is a front view illustrating a state where the sheet cassette is attached to the casing.

The panel cover 9 is formed with an opening 9M through which the user to insert his or her hand for handling the handle portion 11 from the panel cover 9 side. An upper end of the opening 9M is positioned below a lower end of the protruding wall 11A. With this configuration, the handle portion 11 is positioned at a rear surface side of the panel cover 9 and is covered by the panel cover 9, as illustrated in FIG. 6.

Figure 7A:
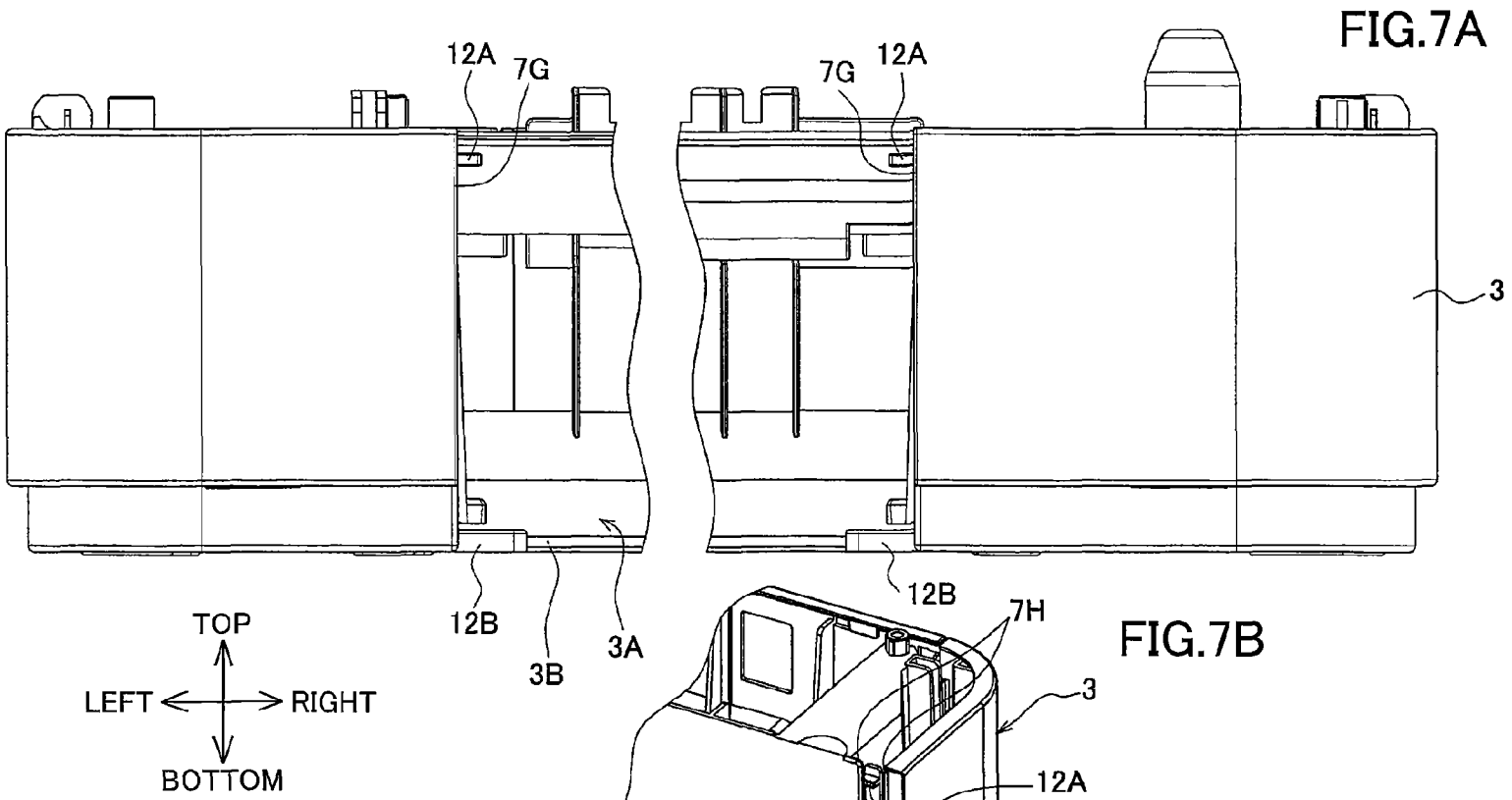
FIG. 7A is a view of the casing as viewed from a side where an opening is formed.
Figure 7B:
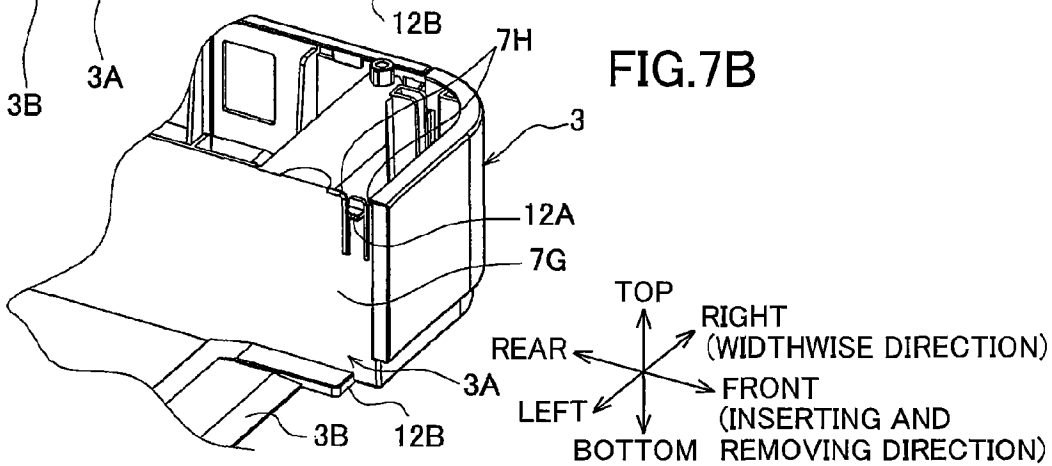
FIG. 7B is an enlarged perspective view of the opening at one end portion of the casing in a widthwise direction.

As illustrated in FIGS. 7A and 7B, the casing 3 is provided with a plurality of abutment portions 12A, 12B contactable with the panel cover 9 when the sheet cassette 7 is attached to the casing 3. The abutment portions 12A, 12B are provided at different positions in both the widthwise direction and the stacking direction. Hereinafter, the abutment portions 12A will be referred to as first abutment portions 12A, and the abutment portions 12B will be referred to as second abutment portions 12B. In this embodiment, two first abutment portions 12A and two second abutment portions 12B are provided in the casing 3.

The two first abutment portions 12A are provided at the casing 3 and spaced apart from each other in the widthwise direction so as to confront outer surfaces of the pair of walls 7C. Each of the first abutment portions 12A is positioned at each side of the opening 3A of the casing 3 in the widthwise direction. More specifically, one of the first abutment portions 12A is positioned at a right side of the opening 3A and remaining one of the first abutment portions 12A is positioned at a left side of the opening 3A. Further, each of the first abutment portions 12A is positioned at a side portion of the casing 3 in the stacking direction, that is, an upper side portion of the casing 3.

The two second abutment portions 12B are provided at the casing 3 and spaced apart from each other in the widthwise direction. Each of the second abutment portions 12B is positioned at each side of the opening 3A of the casing 3 in the widthwise direction. More specifically, one of the second abutment portions 12B is positioned at a left side of the opening 3A and remaining one of the second abutment portions 12B is positioned at a left side of the opening 3A. Further, each of the second abutment portions 12B is positioned at another side portion of the casing 3 in the stacking direction, that is, a lower side portion of the casing 3. The pair of second abutment portions 12B is positioned below the pair of first abutment portions 12A.

Further, the first and second abutment portions 12A, 12B are positioned at visible positions, that is, exposed to the outside through the opening 3A so as to face the front side of the casing 3.

The casing 3 is further provided with a pair of walls 7G at which the pair of first abutment portions 12A are respectively provided, and a bottom portion having a bottom member 3B at which the pair of second abutment portions 12B are provided. The pair of walls 7G confronts each other in the widthwise direction. The bottom portion of the casing 3 including the bottom member 3B is disposed between the pair of walls 7G. The pair of walls 7G and the bottom portion form a space in which the sheet cassette 7 is accommodated. One of the pair of walls 7G is positioned at a right side of the space while remaining one of the pair of walls 7G is positioned at a left side of the space.

Each of the first abutment portions 12A is formed into a rib shape that protrudes toward a center portion of the casing 3 in the widthwise direction from the wall 7G of the casing 3 and that has a long dimension in the frontward/rearward direction and a short dimension in the vertical direction. Incidentally, the pair of walls 7G of the casing 3 confronts the pair of walls 7C of the sheet cassette 7, respectively, in the widthwise direction, when the sheet cassette 7 is attached to the casing 3.

As illustrated in FIG. 7B, a pair of vertically extending slits 7H is formed in each wall 7G so as to interpose the first abutment portion 12A therewith in the frontward/rearward direction. With this configuration, the first abutment portion 12A is positioned at a leading end side of a leaf spring portion of the wall 7G. The first abutment portions 12A can therefore resiliently deformably be displaced in the widthwise direction.

As a result, even if the sheet cassette 7 having a configuration different from the sheet cassette 7 of the present embodiment has a portion abuttable on the first abutment portion 12A in the course of insertion of the sheet cassette 7, the resiliently deformably displaceable first abutment portions 12A can be retracted outward in the widthwise direction. Consequently, the insertion operation of the sheet cassette 7 is not obstructed.

The pair of second abutment portions 12B is each a protrusion protruding frontward from a front end portion of the bottom member 3B provided at a bottom portion of the casing 3. Each second abutment portion 12B is positioned at a corner portion at which the wall 7G and the bottom member 3B are connected. A widthwise dimension of the second abutment portion 12B is set greater than a vertical dimension thereof. The bottom member 3B is plate-like shaped and confronts a front end portion of a lower surface of the stacked plate 7B.

As illustrated in FIG. 8, the panel cover 9 is provided with first abutted portions 9B and second abutted portions 9C at the rear surface side of the panel cover 9. In this embodiment, two first abutted portions 9B and two second abutted portions 9C are provided in the panel cover 9. When the sheet cassette 7 is attached to the casing 3, each first abutted portion 9B is in contact with each first abutment portion 12A, and each second abutted portion 9C is in contact with each second abutment portion 12B. The first and second abutted portions 9B and 9C are formed of resin and integral with the panel cover 9.

That is, the pair of first abutted portions 9B is provided at upper end portions of the side walls 9K, respectively. Further, the panel cover 9 is provided with two sets of a pair of guide portions 9N each protruding farther rearward than the first abutment portion 9B at both upper and lower sides of the first abutment portion 9B in the vertical direction.

Thus, in the present embodiment, the first abutted portion 9B and the pair of guide portions 9N form a U-shaped portion with a rear end being open. As a result, when the sheet cassette 7 is inserted into the casing 3, the pair of guide portions 9N functions as a guide portion for guiding the first abutment portion 12A to the first abutted portion 9B.

Further, as illustrated in FIG. 8, each of the second abutted portions 9C is a protrusion provided at a widthwise end portion of the lower wall 9L and protruding downward from the lower wall 9L. Each second abutted portion 9C has a rear end portion abuttable on the second abutment portion 12B.

In a state where the panel cover 9 is attached to the sheet cassette 7, each of the pair of second abutted portions 9C is fitted into each of a pair of hole portions 7J formed in the wall 7D. A dimension of each of the pair of hole portions 7J in the frontward/rearward direction is greater than a dimension of the second abutment portion 9C in the frontward/rearward direction, allowing the panel cover 9 to be moved with respect to the sheet cassette 7 in the frontward/rearward direction, i.e., in the inserting and removing direction.

Each hole portion 7J has a lower portion being open. Further, the hole portion 7J has a rear wall whose lower end is positioned above a lower end of the front surface of the wall 7D. Accordingly, the rear end portion of each second abutment portion 9C is exposed to the outside through the hole portion 7J, so that the second abutted portion 9C can be abutted on the second abutment portion 12B.

The first and second abutment portions 12A, 12B and the first and second abutted portions 9B, 9C are arranged such that the panel cover 9 and a front surface of the casing 3 are flush with each other in a state where each first abutment portion 12A contact the corresponding first abutted portion 9B and where each second abutment portion 12B contact the corresponding second abutted portion 9C.

The casing 3 has an uneven front surface as illustrated in FIG. 1, and the panel cover 9 and the casing 3 are formed such that the panel cover 9 is flush with a surface of the casing 3 positioned at both sides of the panel cover 9 in the widthwise direction.

Hereinafter, the resilient members provided at a side of the first abutment portions 12A, that is, the resilient members positioned on both widthwise end portions of the wall 7D will be referred to as first resilient members 10A (see FIG. 4). Further, the resilient members positioned farther away from the first abutment portions 12A than the first resilient members 10A, that is, the resilient members positioned closer to the center portion of the wall 7D in the widthwise direction than the first resilient members 10A will be referred to as second resilient members 10B.

The pair of first resilient members 10A is disposed at substantially a center portion of the wall 7D in the vertical direction. Each of the first resilient members 10A protrudes frontward from the wall 7D and a leading end thereof is bent outward in the widthwise direction such that the entire first resilient member 10A forms in a generally L-shape as viewed in the vertical direction.

The pair of second resilient members 10B is disposed above the pair of first resilient members 10A. Similar to the first resilient members 10A, each of the second resilient members 10B protrudes frontward from the wall 7D and a leading end thereof is bent outward in the widthwise direction such that the entire second resilient member 10B forms in a generally L-shape as viewed in the vertical direction.

A length of each of the first resilient member 10A and the second resilient member 10B in the rightward/leftward direction (length from the bent portion thereof to the leading end) is set greater than a length thereof in the frontward/rearward direction (protruding length from the wall 7D). With this configuration, the leading end portion of each of the first resilient member 10A and the second resilient member 10B is configured of a leaf spring that can resiliently be deformed about a base end thereof at a wall 7D side.

Further, as illustrated in FIG. 8, the panel cover 9 is provided with first engagement portions 9D and second engagement portions 9E at the rear surface side of the panel cover 9. In this embodiment, two first engagement portions 9D and two second engagement portions 9E are provided in the panel cover 9.

Each of the first engagement portions 9D is disposed at a center portion of the side wall 9K in the vertical direction and extends toward a center portion of the panel cover 9 in the widthwise direction from a leading end (rear end) of the side wall 9K.

The first engagement portion 9D is positioned between the first resilient member 10A and the wall 7D, and engaged with the first resilient member 10A.

Each of the second engagement portions 9E is provided at the upper wall 9J. The second engagement portions 9E are disposed at positions offset from the center portion of the upper wall 9J in the widthwise direction toward the end portions of the upper wall 9J in the widthwise direction. In other words, the second engagement portions 9E are positioned adjacent to widthwise end portions defining the opening 9M of the panel cover 9.

Each of the second engagement portions 9E extends downward from the upper wall 9J. The second engagement portion 9E is positioned between the second resilient member 10B and the wall 7D, and engaged with the second resilient member 10B.

Figure 9A:
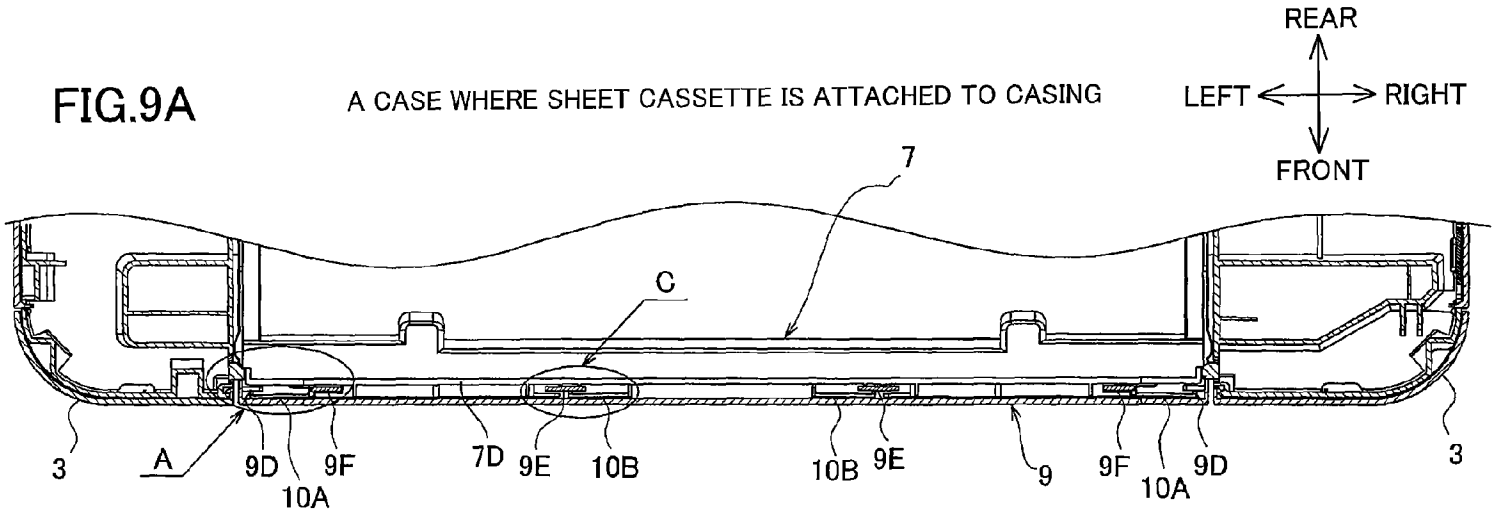
FIGS. 9A and 9B are each a cross-sectional view taken along a line A-B-C-D-E-F of FIG. 6.
Figure 9B:
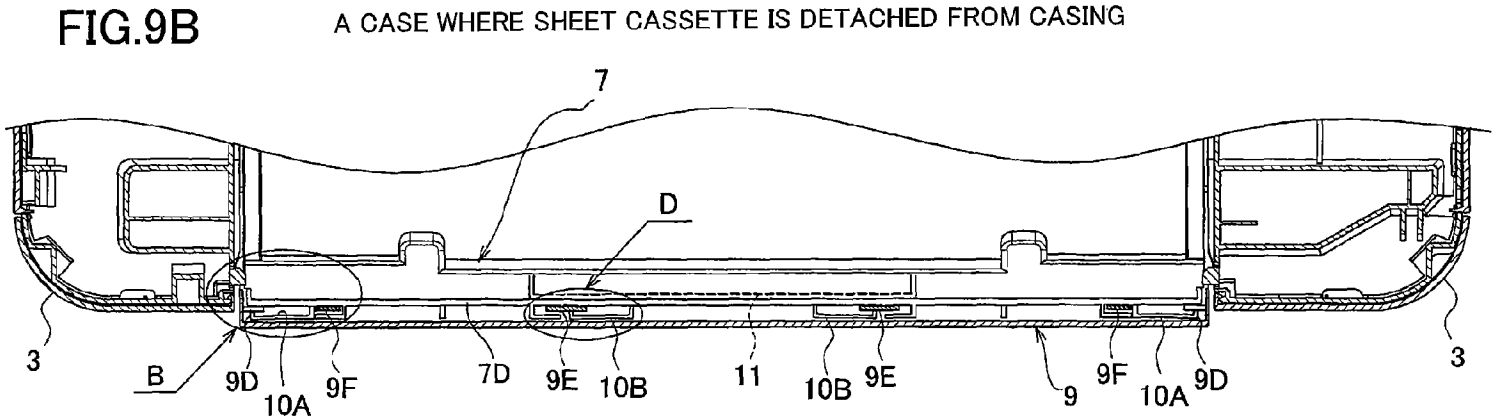

Thus, as illustrated in FIGS. 9A and 9B, the resilient members 10A, 10B apply, to the panel cover 9, a resilient force (resiliency) in a direction in which the panel cover 9 is pulled toward the sheet cassette 7, i.e., the wall 7D. Incidentally, the first and second engagement portions 9D, 9E according to the present embodiment are formed of resin and integral with the panel cover 9.

When attaching the sheet cassette 7 outside the casing 3 thereinto, the user holds the handle portion 11 to insert the sheet cassette 7 into the casing 3 through the opening 3A.

When the sheet cassette 7 is inserted into the casing 3, the first abutment portions 12A come into abutment with the corresponding first abutted portions 9B, and the second abutment portions 12B come into abutment with the corresponding second abutted portions 9C prior to attachment of the sheet cassette 7 into a predetermined attachment position. As a result, the panel cover 9 is subjected to positioning with respect to the casing 3.

In this state, the panel cover 9 is in contact with the first abutment portions 12A and the second abutment portions 12B, so that the panel cover 9 is stopped at the position where the panel cover 9 is subjected to positioning. Only the sheet cassette 7 is further inserted against the resilient forces from the first resilient members 10A and the second resilient members 10B, and provided at the predetermined attachment position. As a result, the sheet cassette 7 can be provided at the predetermined attachment position without impairing the exterior design.

The panel cover 9 according to the present embodiment is connected to the wall 7D through the resilient members 10A, 10B, so that the panel cover 9 is required to be positioned accurately with respect to the casing 3 with the first and second abutted portions 9B, 9C constituting a part of the panel cover 9 and the first and second abutment portions 12A, 12B constituting a part of the casing 3 reliably contacting each other.

Thus, in the present embodiment, in a state where the panel cover 9 contacts the first and second abutment portions 12A, 12B, i.e., the casing 3, a resilient force (resiliency) increased to an extent at which a backlash does not occur in the panel cover 9 needs to be generated in the first resilient members 10A.

On the other hand, a resilient force (resiliency) generated in the second resilient member 10B is employed mainly as a force for connecting the panel cover 9 to the sheet cassette 7. Thus, if the resilient force generated in the second resilient members 10B is increased, the panel cover 9 may excessively be flexurally deformed by the resilient force.

In order to prevent this, in the present embodiment, the resilient force generated in the first resilient members 10A is set greater than the resilient force generated in the second resilient members 10B in a state where the panel cover 9 is in contact with the casing 3.

More specifically, as illustrated in FIG. 10, a leading end of each first resilient member 10A is provided with a protruding portion 10C protruding rearward (toward the first engagement portion 9D), and a leading end of each second resilient member 10B is provided with a protruding portion 10D protruding rearward (toward the second engagement portion 9E). Further, a protruding dimension of the protruding portion 10C provided in the first resilient member 10A is set greater than a protruding dimension of the protruding portion 10D provided in the second resilient member 10B.

With this configuration, in a state where the sheet cassette 7 is attached to the main body to bring the panel cover 9 into contact with the casing 3, a flexure amount of the first resilient member 10A is greater than that of the second resilient member 10B. Accordingly, the resilient force generated in the first resilient member 10A becomes greater than that generated in the second resilient member 10B.

Figure 10A:
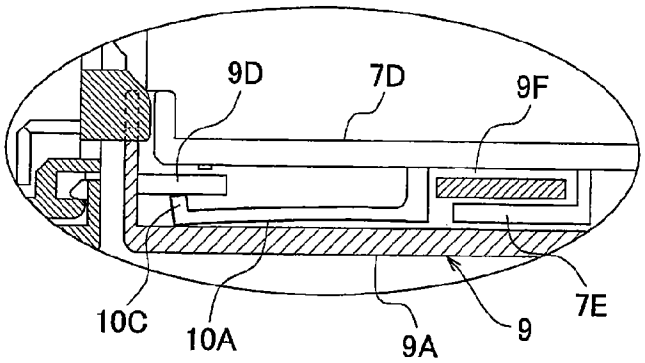
FIG. 10A is an enlarged view of a portion A marked by a circle A of FIG. 9A.
Figure 10C:
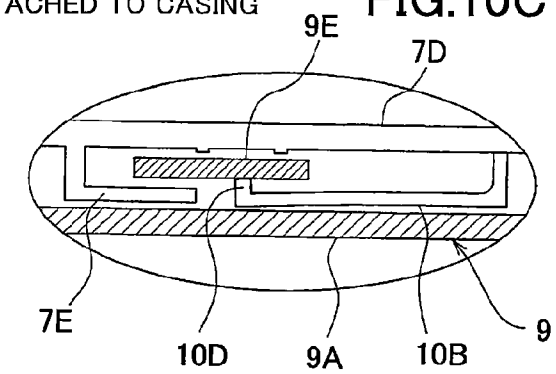
FIG. 10C is an enlarged view of a portion C marked by a circle C of FIG. 9A.
Figure 10B:
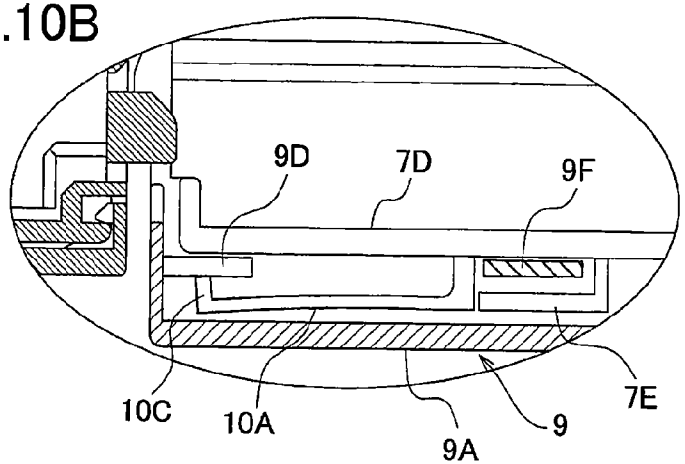
FIG. 10B is an enlarged view of a portion B marked by a circle B of FIG. 9B.
Figure 10D:
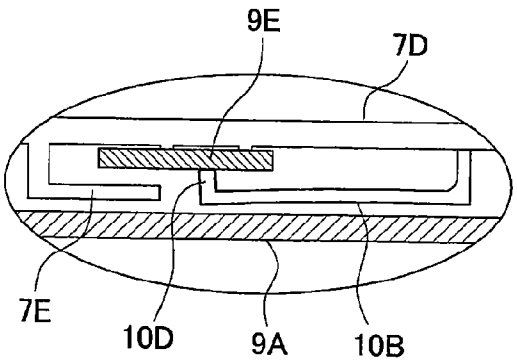
FIG. 10D is an enlarged view of a portion D marked by a circle D of FIG. 9B.

Further, as illustrated in FIGS. 10A and 10B, since the protruding dimension of the protruding portion 10C provided in the first resilient member 10A is greater than the protruding dimension of the protruding portion 10D provided in the second resilient member 10B, the first resilient member 10A applies a greater resilient force (resiliency) to the panel cover 9 in a state where the panel cover 9 is in contact with the casing 3 than in a state where the panel cover 9 is not in contact with the casing 3.

Further, as illustrated in FIG. 4, the pair of second resilient members 10B and the handle portion 11, both formed in the wall 7D, are positioned in the same region with respect to the widthwise direction. That is, in the present embodiment, the pair of second resilient members 10B and the handle portion 11 are both provided at the center portion of the wall 7D in the widthwise direction.

A portion of the panel cover 9 that corresponds to a portion below the handle portion 11 is cut out for the user to insert his or her hand to handle the handle portion 11. Therefore, the pair of second resilient members 10B is positioned above the handle portion 11 at the widthwise center portion of the wall 7D.

Further, as illustrated in FIG. 8, the panel cover 9 is provided with a plurality of plate-like regulation protrusions 9F at the rear surface side of the panel cover 9. Each of the plurality of regulation protrusions 9F protrudes downward from the upper wall 9J. The regulation protrusions 9F are discretely disposed in the widthwise direction.

Incidentally, in the present embodiment, each of the second engagement portions 9E has the similar shape and function to those of each of the regulation protrusions 9F. Thus, unless otherwise specified, the regulation protrusion 9F includes the second engagement portions 9E.

Further, as illustrated in FIGS. 10A through 10D, the wall 7D is provided with regulation portions 7E contactable with the regulation protrusions 9F from an outer surface 9A side. In this embodiment, four regulation portions 7E are provided in the wall 7D.

Each of the regulation portions 7E is a hook portion having a generally L-shape as viewed in the vertical direction. More specifically, two of the four regulation portions 7E are positioned relatively at the center portion of the wall 7D in the widthwise direction, and protrude frontward from the wall 7D and then bend toward the center portion of the wall 7D in the widthwise direction. Remaining two of the four regulation portions 7E are positioned relatively at the end portions of the wall 7D in the widthwise direction, and protrude frontward from the wall 7D and then bend toward the end portions of the wall 7D in the widthwise direction. A lower end of the bent portion of each regulation portion 7E is connected to the wall 7D, thereby fixing the regulation portion 7E to the wall 7D.

An interval between the regulation portion 7E and the wall 7D are made greater than a length (thickness) of the regulation protrusion 9F in the frontward/rearward direction. Thus, in a state where the panel cover 9 is attached to the sheet cassette 7 but the sheet cassette 7 is not attached to the casing 3, the regulation portion 7E and the regulation protrusion 9F do not contact each other. In the present embodiment, the regulation portions 7E are formed of resin and integral with the wall 7D, and the regulation protrusions 9F are formed of resin and integral with the panel cover 9.

In case the panel cover 9 is deformed outward to be isolated from the wall 7D, the regulation portions 7E is brought into contact with the regulation protrusions 9F, that is, the panel cover 9. This prevents the panel cover 9 from being significantly flexurally deformed outside with respect to the design surface of the casing 3.

Movement of the panel cover 9 is allowed until the regulation protrusions 9F of the panel cover 9 abut on the regulation portions 7E, and when the regulation protrusions 9F abut on the regulation portions 7E, further movement of the panel cover 9 is regulated.

In particular, each second engagement portion 9E is disposed adjacent to the corresponding second resilient member 10B in the widthwise direction and disposed across an existing area of the corresponding regulation portion 7E and an existing area of the corresponding second resilient member 10B so as to be abuttable on both the corresponding regulation portion 7E and the corresponding second resilient member 10B.

In case the panel cover 9 is deformed inward so as to move toward the wall 7D, the regulation protrusions 9F are brought into contact with the wall 7D. This prevents the panel cover 9 from being significantly flexurally deformed inward with respect to the design surface of the casing 3.

In the present embodiment, as illustrated in FIG. 8, the panel cover 9 is further provided with a plurality of regulation protrusions 9G at a lower end portion of the panel cover 9. In this embodiment, two regulation protrusions 9G are provided in the panel cover 9. A length of each of the regulation protrusions 9G in the frontward/rearward direction is made smaller than a length of each of hole portions 7K formed in the wall 7D in the frontward/rearward direction. These regulation protrusions 9G are fitted into the hole portions 7K formed in the wall 7D as illustrated in FIG. 8 to regulate flexural deformation and excessive movement of the panel cover 9.

3. Features of Image Forming Device (in Particular, Sheet Cassette) According to Embodiment According to the present embodiment, the handle portion 11 of the sheet cassette 7 is provided at the panel cover 9 side of the sheet cassette 7. With this configuration, the entire inserting and removing force can be received by the handle portion 11 provided in the sheet cassette 7.

This prevents the inserting and removing force from being applied to the first and second resilient members 10A, 10B that connect the panel cover 9 to the sheet cassette 7, which in turn prevents inserting/removing workability of the sheet cassette 7 from being reduced.

Further, according to the present embodiment, each of the first resilient members 10A generates a greater resilient force (resiliency) in a state where the panel cover 9 contacts the first and second abutment portions 12A, 12B, that is, the casing 3, than in a state where the panel cover 9 does not contact the casing 3.

With this configuration, in the present embodiment, when the panel cover 9 contacts the casing 3, the panel cover 9 is subjected to positioning with respect directly to the casing 3. Thus, continuity between the outer surface 9A of the panel cover 9 and the exterior design surface of the casing 3 can be increased to thereby improve the design of the image forming device 1.

Further, since each of the first resilient members 10A generates a greater resilient force in a state where the panel cover 9 contacts the casing 3 than in a state where the panel cover 9 does not contact the casing 3, the panel cover 9 can reliably be brought into contact with the casing 3. Thus, the panel cover 9 can be subjected to positioning precisely with respect to the casing 3.

Further, according to the present embodiment, the plurality of resilient members 10A, 10B is provided in the sheet cassette 7. Thus, even if an external force is applied to the panel cover 9, the external force can be distributed over the plurality of resilient members 10A, 10B.

The first resilient members 10A play a role of bringing the panel cover 9 into contact reliably with the casing 3, and further, apply, to the panel cover 9, a resilient force in a direction in which the panel cover 9 is pulled to the wall 7D.

Thus, in the present embodiment, when the first and second abutment portions 12A, 12B and the panel cover 9 contact each other, a force in a direction that makes the panel cover 9 be spaced apart from the wall 7D is applied to the panel cover 9 by a reaction force from the first and second abutment portions 12A, 12B. Therefore, in a state where the panel cover 9 and the casing 3 contact each other, a resilient force generated in the first resilient members 10A can be made comparatively great.

On the other hand, in the present embodiment, in a state where the panel cover 9 contacts the casing 3, the first resilient members 10A generate a greater resilient force than the second resilient members 10B. This can bring the panel cover 9 and the first and second abutment portions 12A, 12B into contact reliably with each other while preventing the panel cover 9 from being significantly flexurally deformed.

Further, according to the present embodiment, at least one of the resilient members 10A, 10B, that is, the pair of the second resilient members 10B is provided in the same region as the handle portion 11 in the widthwise direction.

Thus, in the present embodiment, even if a user who intends to handle the handle portion 11 erroneously handles the panel cover 9, the handling force can be received not only by the panel cover 9 but also the pair of second resilient members 10B, thereby preventing the panel cover 9 from being significantly flexurally deformed.

Further, according to the present embodiment, the plurality of first abutment portions 12A and the plurality of second abutment portions 12B are disposed at different positions in the widthwise direction and in the stacking direction. With this configuration, in the present embodiment, the panel cover 9 contacts the plurality of first abutment portions 12A and the plurality of second abutment portions 12B, thereby preventing the panel cover 9 from being significantly deformed at a specified position.

Further, in the present embodiment, the handle portion 11 is positioned on the rear surface side of the panel cover 9 and is covered by the panel cover 9. Thus, the handle portion 11 does not appear in the exterior design to thereby improve the design of the image forming device 1.

Further, according to the present embodiment, the first and second abutment portions 12A, 12B are exposed at positions visible through the opening 3A. With this configuration, in the present embodiment, as the sheet cassette 7 is inserted into the opening 3A, the panel cover 9 automatically contacts the first and second abutment portions 12A, 12B to fix the position of the panel cover 9 with respect to the casing 3.

On the other hand, as the sheet cassette 7 is removed from the casing 3, the panel cover 9 is automatically separated from the first and second abutment portions 12A, 12B, whereby the inserting and removing workability of the sheet cassette 7 can be increased.

In the known image forming device, when the sheet cassette is subjected to insertion and removal operations, the hook needs to be significantly resiliently deformed, so that an inserting and removing force great enough to at least resiliently deform the hook is required. Therefore, the inserting and removing workability is lower in the known image forming device than in the present embodiment.

Further, according to the present embodiment, the regulation portions 7E are provided in the sheet cassette 7. The regulation portions 7E contact the panel cover 9 to regulate displacement of the panel cover 9 with respect to the sheet cassette 7.

With this configuration, in the present embodiment, the panel cover 9 can be prevented from being significantly flexurally deformed outside with respect to the design surface of the casing 3. This can prevent design of the image forming device 1 from deteriorating.

Further, according to the present embodiment, the first and second resilient members 10A, 10B are integrally formed with the wall 7D of the sheet cassette 7. With this configuration, the first and second resilient members 10A, 10B can be formed while suppressing an increase in production cost of the image forming device 1.

4. Other Embodiments

Although the present invention is applied to an inkjet printer in the above embodiment, application of the present invention is not limited to this, but the present invention may be applied to an electrophotographic type image forming device.

In the above embodiment, bringing the panel cover 9 and the casing 3 into contact with each other results in continuity between the outer surface 9A of the panel cover 9 and the exterior design surface of the casing 3. However, the present invention is not limited to this. For example, the panel cover 9 and the casing 3 may be made to be non-contact with each other.

Although the plurality of resilient members 10A, 10B are provided in the above embodiment, the present invention is not limited to this.

Further, although the pair of second resilient members 10B are provided at the widthwise center portion of the wall 7D of the sheet cassette 7, the present invention is not limited to this.

Further, although the resilient members 10A, 10B apply to the panel cover 9 a resilient force in a direction in which the panel cover 9 is pulled to the sheet cassette 7, the present invention is not limited to this. For example, as in the case of the invention disclosed in Japanese patent application publication 2011-51665, the panel cover 9 may be pressed by using the resilient members 10A, 10B. In this case, the first abutment portions 12A and the like may be provided at positions not visible through the opening 3A.

Further, the first and second resilient members 10A, 10B are each a leaf spring integrally formed with the wall 7D. However, the present invention is not limited to this. For example, the first and second resilient members 10A, 10B may each be a coil spring formed separately from the wall 7D.

In the above embodiment, the second engagement portions 9E serve also as the regulation protrusion 9F since the regulation portions 7E provided at the center side of the wall 7D in the widthwise direction are adjacent to the second resilient members 10B. However, the present invention is not limited to this.

In the above embodiment, the protruding portions 10C, 10D are formed at the leading end portions of the first and second resilient members 10A, 10B, respectively, and the protruding dimension of each of the protruding portions 10C is set greater than that of each of the protruding portions 10D, to thereby set the resilient forces of the first and second resilient members 10A, 10B, respectively. However, the present invention is not limited to this. For example, the protruding portions 10C, 10D may be dispensed with. In this case, the first and second resilient members 10A, 10B are made different in plate thickness or shape to set the resilient forces thereof.

In the above embodiment, the entire opening 3A is closed by the panel cover 9 and the sheet cassette 7 when the sheet cassette 7 is attached to the casing 3. However, the present invention is not limited to this. Only a part of the opening 3A may be closed by the panel cover 9.

While the present invention has been described in detail with reference to the embodiments thereof, it would be apparent to those skilled in the art that various changes and modifications may be made therein without departing from the spirit of the present invention.

What is claimed is:

1. An image forming device comprising:

an image forming unit configured to form an image on a sheet;

a casing formed with an opening and configured to accommodate the image forming unit therein;

a tray configured to accommodate in a stacked state a plurality of sheets to be fed toward the image forming unit, the tray configured to be inserted into the casing through the opening to be attached to the casing and removed from the casing through the opening to be detached from the casing;

a cover connected to the tray and moved relative to the tray, the cover being configured to cover at least a part of the opening when the tray is attached to the casing;

a handle portion provided at the tray; and a resilient portion configured to be resiliently deformed, wherein the casing is provided with an abutment portion configured to be contacted with the cover when the tray is attached to the casing, wherein the cover is connected to the tray through the resilient portion, wherein the resilient portion provides a greater resilient force in a state where the cover is in contact with the abutment portion than in a state where the cover is spaced apart from the abutment portion, wherein the resilient force, in a state where the cover is spaced apart from the abutment portion, is greater than zero, and wherein the resilient portion exerts the resilient force on the cover, such that the resilient force is oriented in a direction for attracting the cover toward the tray.

2. The image forming device as claimed in claim 1, wherein the abutment portion is exposed to an outside and provided at a position visible through the opening.

3. The image forming device as claimed in claim 1, wherein the resilient portion includes a plurality of resilient elements.

4. The image forming device as claimed in claim 3, wherein the plurality of resilient elements includes a first resilient element and a second resilient element; and wherein, when the cover is in contact with the abutment portion, a distance defined between the first resilient element and the abutment portion being smaller than a distance defined between the second resilient element and the abutment portion, the first resilient element generating a resilient force greater than a resilient force generated by the second resilient element.

5. The image forming device as claimed in claim 3, wherein the tray is inserted into and removed from the casing in an inserting and removing direction, the plurality of sheets being stacked in a stacking direction; and wherein at least one of the plurality of resilient elements is provided in a region of the tray the same as a region where the handle portion is provided with respect to a widthwise direction perpendicular to the inserting and removing direction and the stacking direction.

6. The image forming device as claimed in claim 1, wherein the tray is inserted into and removed from the casing in an inserting and removing direction, the plurality of sheets being stacked in a stacking direction; and wherein the abutment portion includes a plurality of abutment elements, the plurality of abutment elements being provided at different positions with respect to the stacking direction and a widthwise direction perpendicular to the inserting and removing direction and the stacking direction.

7. The image forming device as claimed in claim 1, wherein the tray has a wall confronting the cover; and wherein the resilient portion is integral with the wall.

8. The image forming device as claimed in claim 1, wherein the tray is inserted into and removed from the casing in an inserting and removing direction;

wherein, when the tray is attached to the casing, the tray in its entirety is positioned farther inside the casing than the cover is; and wherein the handle portion is positioned between the tray and the cover in the inserting and removing direction.

9. The image forming device as claimed in claim 8, wherein the abutment portion is exposed to an outside and provided at a position visible through the opening.

10. The image forming device as claimed in claim 1, wherein the tray is provided with a regulation portion configured to be contacted with the cover, thereby regulating displacement of the cover relative to the tray.

* * * * *